US006958707B1

(12) United States Patent
Siegel

(10) Patent No.: US 6,958,707 B1
(45) Date of Patent: Oct. 25, 2005

(54) EMERGENCY VEHICLE ALERT SYSTEM

(76) Inventor: Michael Aaron Siegel, 303 N. Maple Dr., Beverly Hills, CA (US) 90210

( * ) Notice: Subject to any disclaimer, the term of this patent is extended or adjusted under 35 U.S.C. 154(b) by 95 days.

(21) Appl. No.: 10/337,690

(22) Filed: Jan. 6, 2003

Related U.S. Application Data

(63) Continuation-in-part of application No. 09/883,452, filed on Jun. 18, 2001, now Pat. No. 6,614,362.

(51) Int. Cl.[7] ..... G08G 1/00

(52) U.S. Cl. ..... 340/902; 340/435; 340/539.21; 340/903; 701/300; 701/301

(58) Field of Search ..... 340/902, 903, 340/988, 435, 904; 701/300, 301; 342/454, 342/455, 457, 458

(56) References Cited

U.S. PATENT DOCUMENTS 5,767,788 A * 6/1998 Ness ..... 340/825.49
5,926,112 A * 7/1999 Hartzell ..... 340/902
6,087,961 A * 7/2000 Markow ..... 340/902
6,160,493 A * 12/2000 Smith ..... 340/902
6,292,109 B1 * 9/2001 Murano et al. ..... 340/903
6,326,903 B1 * 12/2001 Gross et al. ..... 340/988
6,529,831 B1 * 3/2003 Smith et al. ..... 701/301
6,614,362 B2 * 9/2003 Siegel ..... 340/902
6,630,892 B1 * 10/2003 Crockford et al. ..... 340/904

* cited by examiner

*Primary Examiner*—Davetta W. Goins
(74) *Attorney, Agent, or Firm*—Koestner Bertani LLP; Mary Jo Bertani

(57) ABSTRACT

An apparatus and method for an emergency vehicle alert system transmits signals from one or more emergency vehicles to nearby commuter vehicles. When an initiation switch in the emergency vehicle is activated, a transmitter broadcasts a unique identifier for the vehicle. Information regarding other characteristics such as position, speed, route, and direction of travel can also be transmitted to provide alert information to commuter vehicles in the vicinity of the emergency vehicles. The information is presented to occupants of the commuter vehicle and can include audio and visual displays such as lights, voice warnings, moving map display with symbols representing the vehicles' position relative to one another, and a textual display providing identification and distance information.

50 Claims, 10 Drawing Sheets

EMERGENCY VEHICLE ALERT SYSTEM

BACKGROUND

The field of invention relates to the transmission of signals for emergency vehicles. More specifically, this present invention relates to a system for transmitting signals from a emergency vehicles to nearby commuter vehicles.

Various methods and devices have been used to transmit a signal or warning from an emergency vehicle to nearby vehicles, such as the siren of a fire truck or ambulance. Another method involves sending a signal from the emergency vehicle to the traffic light at an upcoming intersection. The traffic light is programmed to turn red in all directions when the traffic light receives the signal.

Sirens have several disadvantages. The volume of the siren limits the distance at which the siren can be heard. Excessive volume can be damaging to the ears of commuters, pedestrians, and the occupants of the emergency vehicle. An additional disadvantage of siren alerts is that commuters have difficulty discerning how many emergency vehicles are in the area or knowing the direction the emergency vehicles are traveling. One emergency vehicle sounding a siren can pass by the commuter vehicle. The commuter may erroneously assume that only one emergency vehicle is in the vicinity and resume travel on the road once the first emergency vehicle passes. In many circumstances, a second emergency vehicle is traveling some distance behind the first emergency vehicle, catching the commuter unaware as he or she enters the path of the second emergency vehicle. Such a situation can force the second emergency vehicle to swerve around the commuter's vehicle, creating a hazard to occupants of the commuter vehicle, the second emergency vehicle, as well as other vehicles in the vicinity.

Another disadvantage associated with the use of sirens is that many commuter vehicles are constructed with a much quieter interior than in past years. The quiet vehicles make it more difficult to hear outside noises, including the blare of a siren. More people live in urban cities and fewer people reside in sparsely traveled rural areas. The cities are densely populated and noisy, which hinders the ability of drivers to adequately hear and discern the siren, above the loud background noises. Additionally, cities have large, tall buildings that block the transmission of the siren sound. The siren sound tends to be funneled down the street. The siren sound does not effectively go around corners. Sound waves can bounce off of buildings and travel around corners to a certain limit, but sound waves do have a tendency to continue travel in the preexisting unobstructed direction.

Sending a signal from the emergency vehicle to a traffic light also has disadvantages. The emergency vehicle transmits a signal to the traffic light at an upcoming intersection. The traffic light responds by turning the traffic signals red in all directions. Commuter traffic is halted, allowing the emergency vehicle to pass easily through the intersection.

Installing the transmitter device on each emergency vehicle is only a small portion of the cost. Each traffic light must have a receiver installed. Installing the receiver on new traffic lights can be expensive. The costs are even more prohibitive when the existing traffic lights need to be retrofitted with a receiver. Coordinating the halting of traffic during the installation can be very time consuming and disruptive to commuters. The cost of retrofitting all of the traffic signals in a city is borne by the city government. The costs can be prohibitive and most cities decline to use the method.

An effective emergency vehicle alert system is very important. Many lives are lost each year in vehicle accidents involving emergency vehicles. Methods and systems are needed that will minimize the risk of the emergency vehicle incurring a collision with a commuter vehicle, which results in injury or death. An emergency vehicle alert system that transmitted a signal farther than the hearing range of a siren would allow commuter vehicles to pull to the side of the road sooner. The roads would be less obstructed and the emergency vehicle could travel faster, reaching the accident scene sooner and delivering patients to treatment centers more rapidly.

Therefore, there is a need for an emergency vehicle alert system that will transmit a signal farther than the hearing range of a siren. Furthermore, there is a need for a system that is affordable to implement. Additionally the emergency vehicle alert system should provide an indication when more than one emergency vehicle is present in the vicinity. The system should also provide an indication of the relative position of the emergency vehicle(s) in relation to the commuter vehicle.

SUMMARY

An apparatus and method for an emergency vehicle alert system is provided that transmits signals from one or more emergency vehicles to nearby commuter vehicles. When an initiation switch in the emergency vehicle is activated, a transmitter broadcasts a unique identifier for the vehicle. Information regarding other characteristics such as position, speed, route, and direction of travel can also be transmitted to provide alert information to commuter vehicles in the vicinity of the emergency vehicles. The information is presented to occupants of the commuter vehicle and can include audio and visual displays such as lights, voice warnings, moving map display with symbols representing the vehicles' position relative to one another, and a textual display providing identification and distance information.

The emergency vehicle alert system (EVAS) generally transmits a signal farther than the hearing range of a siren. The signal can be sent using one of many commonly available communication frequencies. Communication frequencies can transmit for many miles, in contrast to siren sounds that are limited in transmission range. Amplifiers can be used in the most densely congested downtown areas, where tall building may hinder the communication frequencies.

An additional advantage of the emergency vehicle alert system is distributing the system costs to commuter vehicle drivers, in addition to the municipal governments. The receiver is located in the commuter vehicle. The receiver can be original equipment from the factory on new cars. Existing commuter vehicles can be retrofitted with a receiver purchased from a local auto parts store. Also, local governments may coordinate reduced cost quantity purchases for the local citizens.

Various types of information regarding the emergency vehicles can be transmitted directly to commuter vehicles in the vicinity of the emergency vehicles, or via a central server. The central server can be co-located with existing wireless communication facilities, such as cellular communication sites, which can communicate with one another to handoff receiving and transmitting alert signals to the next facility as the emergency vehicles travel out of the transmission area of the current site. The central server can determine the position of the emergency vehicles and the commuter vehicles in the vicinity of the route of the emergency vehicles. The central server can determine when to transmit the alert signal to the commuter vehicles based on the speed of the commuter vehicles and the emergency vehicles. An all-clear signal can also be transmitted to the commuter vehicles when all of the emergency vehicles have passed the route of the commuter vehicles.

When the emergency vehicles transmit alert signals directly to commuter vehicles, a targeted transmission pattern in front and along the sides of the emergency vehicles can be utilized to provide alert signals while the emergency vehicles are heading toward or in the path of the commuter vehicles. Once the emergency vehicles have passed the commuter vehicle, an all-clear signal can be issued.

Commuter vehicles can include a variety of lights, audio devices, and displays for presenting the alert information to the occupants of the commuter vehicle. While a dedicated stand-alone unit can be utilized to present all of the alert information, systems such as car stereo system and navigation/moving map systems already built-in to the commuter vehicle can also be utilized.

Commuter vehicle drivers will clear the roads sooner and more completely. The emergency vehicles can maintain higher speeds while traveling to the scene of an accident or injury, thus arriving in less time. Victim's lives will be saved by sooner treatment. Fewer accidents will occur between emergency vehicles and commuter vehicles.

Although the present invention is briefly summarized, the fuller understanding of the invention is obtained by the following drawings, detailed description, and appended claims.

BRIEF DESCRIPTION OF THE DRAWINGS

These and other aspects, features and advantages of the present invention will become better understood with reference to the accompanying drawing, wherein.

DETAILED DESCRIPTION

Figure 1A:
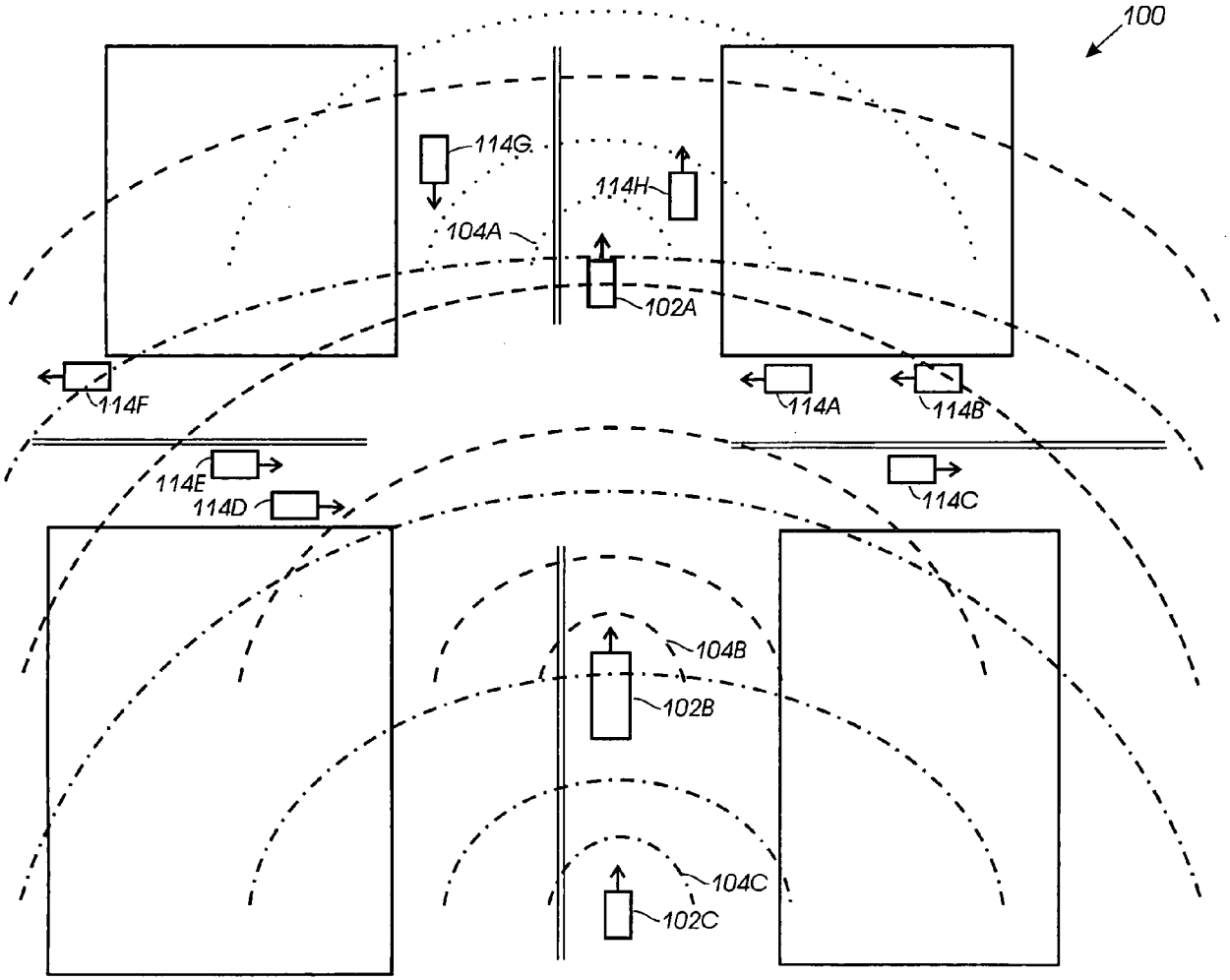
FIG. 1A shows an overhead view of an intersection with emergency vehicles transmitting signals to alert occupants of commuter vehicles of the oncoming presence of the emergency vehicles.

FIG. 1A shows a conceptual view of the operation of an embodiment of emergency vehicle alert system (EVAS) 100 with emergency vehicles 102A, 102B, 102C transmitting respective alert signals 104A, 104B, 104C, thereby alerting commuter vehicles 114A through 114H of the oncoming presence of emergency vehicles 102A, 102B, 102C. To simplify notation, the reference number 102 is utilized hereinafter to refer to any one or more of emergency vehicles 102A through 102C; reference number 104 is utilized hereinafter to refer to any one or more of alert signals 104A through 104C; and reference number 114 is utilized hereinafter to refer to any one or more of commuter vehicles 114A through 114H.

In some embodiments, signals 104 are generated by a transmitter located in each of emergency vehicles 102 and include a unique identifier that allows an alert receiver system in commuter vehicles 114 to discriminate between alert signals 104 from different emergency vehicles 102. Information regarding the number and direction of travel of emergency vehicles 102 distinguished by the alert receiver system is presented to the occupants. Other emergency vehicles 102 in the area equipped with an alert receiver system can also detect alert signals 104 transmitted by other emergency vehicles 102.

Figure 2A:
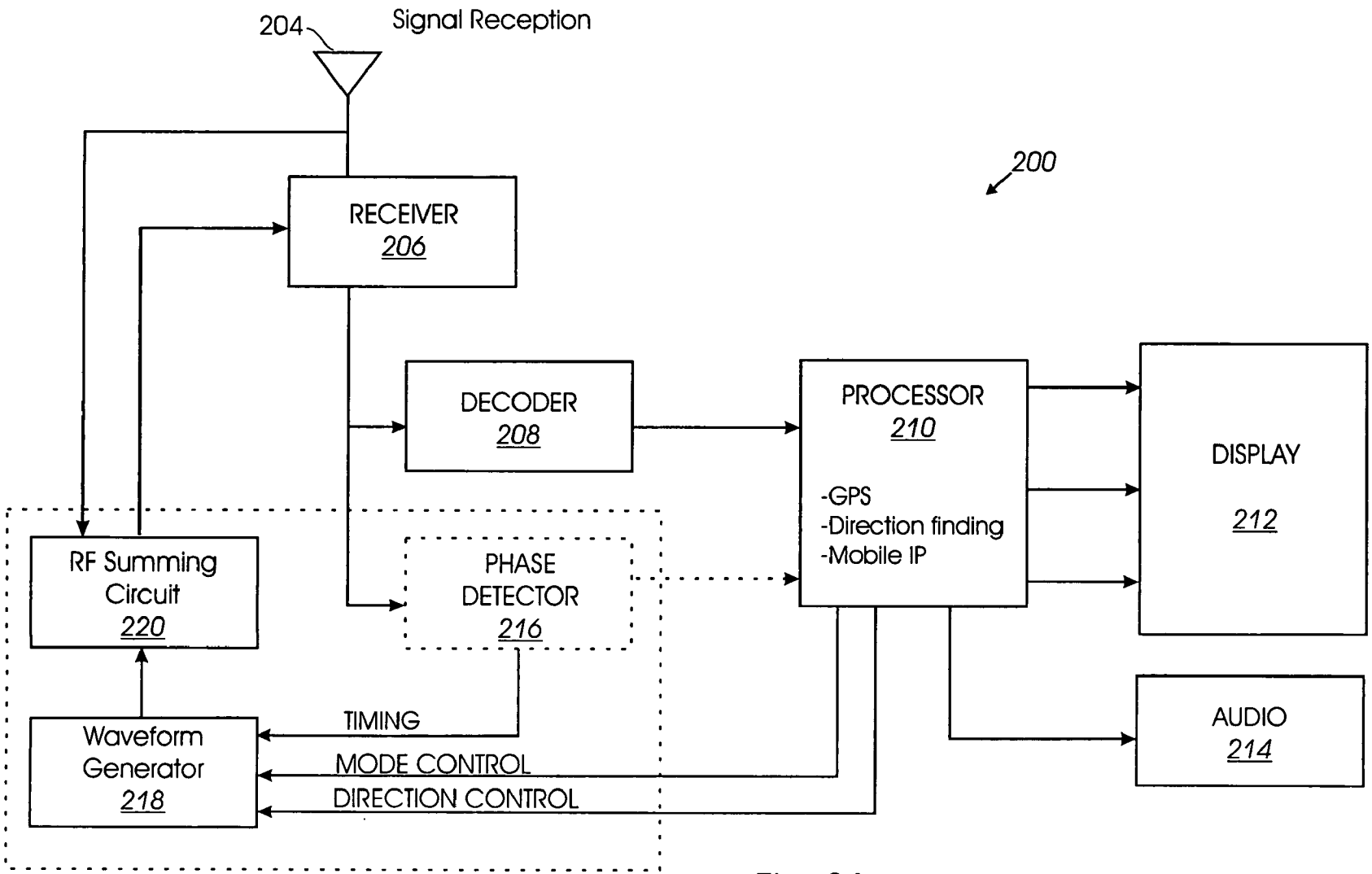
FIG. 2A is a block diagram of components included in an embodiment of an emergency vehicle alert receiver and notification system for a commuter vehicle.
Figure 2B:
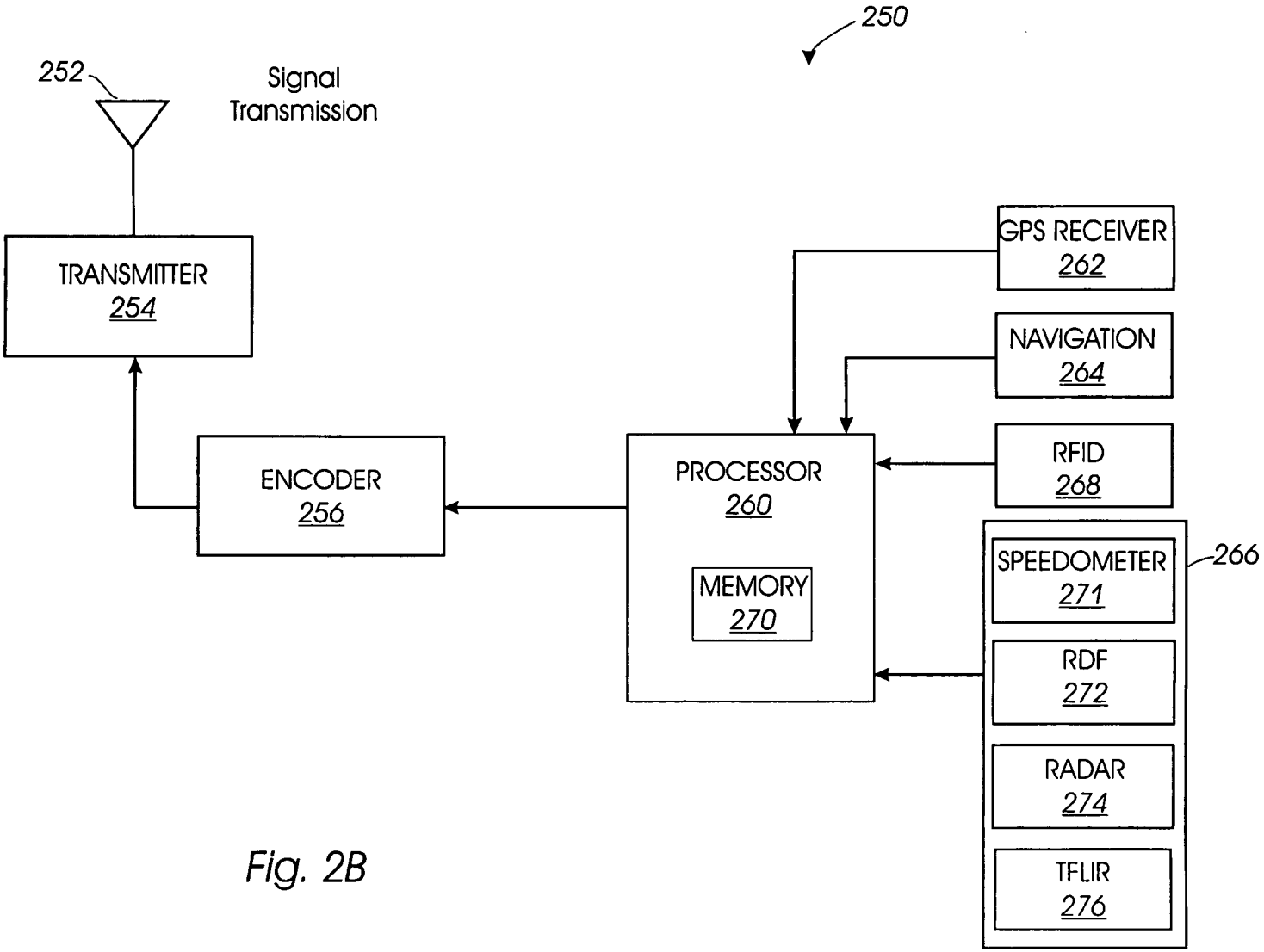
FIG. 2B is a block diagram of components included in an embodiment of an emergency vehicle alert transmitter system for an emergency vehicle.

Referring now to FIGS. 1A and 2A, FIG. 2A is a block diagram of components included in an embodiment of alert receiver system 200 that can be installed in one or more of commuter vehicles 114. A variety of wireless technologies can be utilized to implement alert receiver system 200 as well as an alert transmitter system that can be installed in emergency vehicles 102 or in a centralized alert server as further described herein. Some wireless technologies that can be utilized to implement various embodiments of components include Global Positioning System (GPS), radio frequency identification (RFID), radio direction finding systems, and wireless internet protocol (IP). Radio frequency transmissions output by emergency vehicles 102 can utilize any suitable frequency, format, and modulation technique.

Antenna 204 represents one or more antenna devices that are capable of receiving RF transmission signals at the desired frequencies including, for example, GPS signals, RFID signals, mobile internet protocol (IP) signals, and/or radio direction finding (RDF) signals, among others. Receiver 206 includes one or more receiver devices that are capable of receiving RF signals from antenna 204, tuning the desired frequency(s), and detecting/demodulating the information in the desired signal(s). Decoder 208 de-serializes the received data, determines whether the data is compatible with alert receiver system 200, and sends valid data bits to processor 210. Although the embodiment of alert receiver system 200 shown in FIG. 2A includes components for handling digital data, alternative embodiments of alert receiver system 200 can include components for handling analog signals in addition to, or instead of, digital signals.

Global Positioning System (GPS) receivers are commonly used for determining the geographic position of a vehicle utilizing signals transmitted from GPS satellites. Many commuter vehicles 114, as well as emergency vehicles 102, are equipped with GPS receivers and navigation systems that provide information regarding the vehicle's latitude, longitude, and altitude. Some GPS systems include a display that shows the position of the vehicle on a map. As the vehicle moves, its position is updated on the map. This capability is often referred to as a "moving map." Navigation systems are capable of receiving intended destination information for the vehicle, and determining an optimized route between the vehicle's current location and the destination. A vehicle equipped with a GPS receiver and navigation system can also include components to transmit information regarding the vehicle's identity, position, speed, and/or route. Alert receiver system 200 can receive this identity, position, speed, and route information as it transmitted by other vehicle(s) and present it to occupants in the receiving vehicle via a display 212, such as a moving map, and/or audio device 216, such as a speaker.

The term RFID (radio frequency identification) describes the use of radio frequency signals to provide information regarding the identity, location, and other characterizing information about emergency vehicles 102. In an RFID system, a RFID tag can be attached to each of emergency vehicles 102 to provide information, such as the vehicle identification number and the location of the vehicle. The information transmitted from the RFID tag can be utilized by alert receiver system 200.

Information can also be communicated between emergency vehicles 102 and commuter vehicles 114 via a centralized server and mobile networking technologies. For example, Advanced Traffic Information Systems (ATIS) initiatives have been undertaken by federal and state highway departments with the aim of collecting and processing useful information about transportation conditions and travel options in order to allow commuters to take full advantage of the transportation system. Such a system can provide real-time information to vehicle users regarding road conditions, estimated travel times, open routes, traffic congestion, and weather conditions from centralized information servers.

Figure 1B:
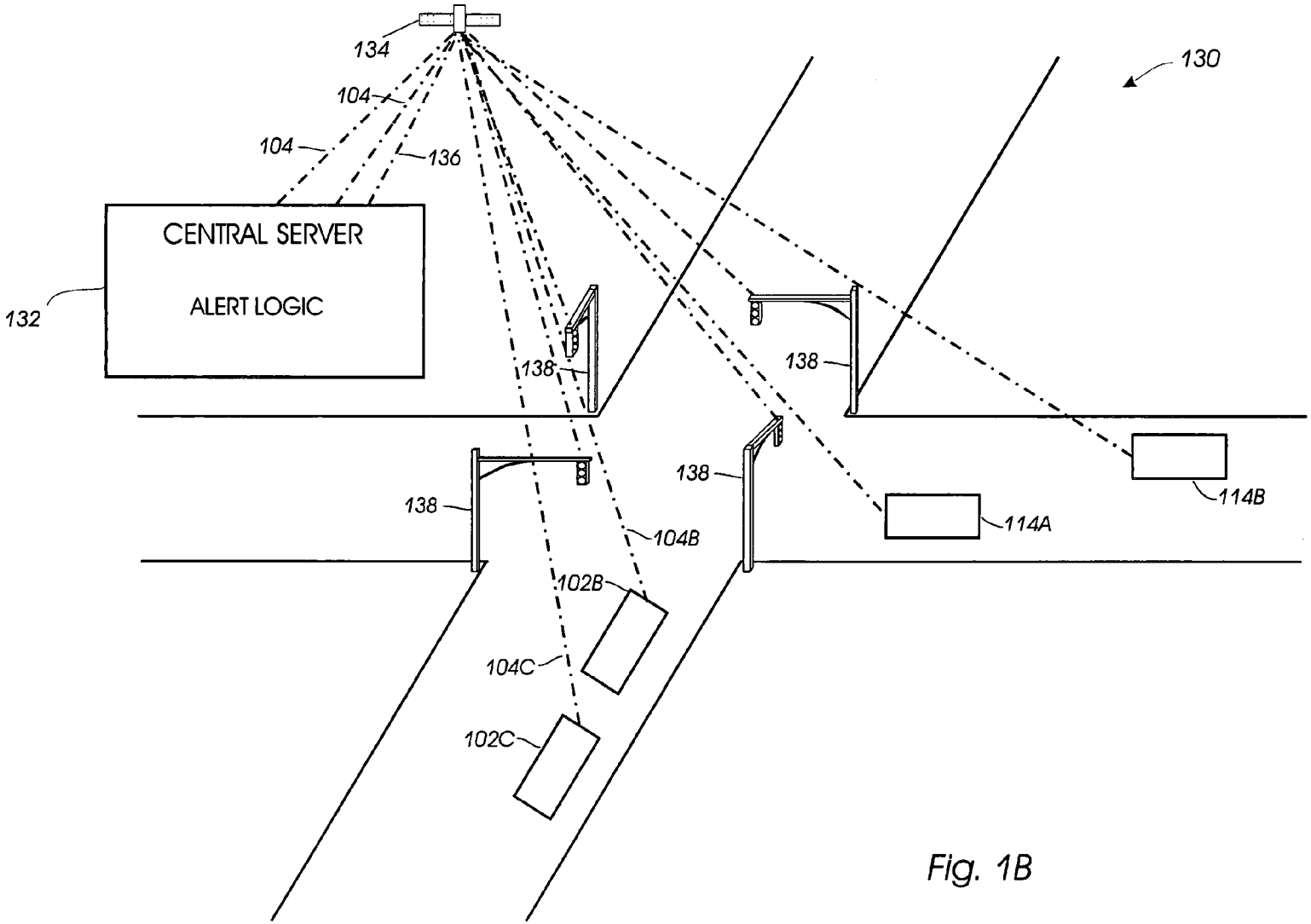
FIG. 1B shows an overhead view of an intersection with emergency vehicles transmitting information to a central server, and the central server sending signals to alert occupants of commuter vehicles of the oncoming presence of the emergency vehicles.

FIG. 1B shows an example of another embodiment of an alert system 130 using central server 132 configured to receive alert signals 104 from emergency vehicles 102, and to transmit alert signals 104 to commuter vehicles 114 in the vicinity of emergency vehicles 102. The messages can be communicated using any suitable wireless networking technologies, such as mobile IP communication via a network of one or more communication satellites 134 or cellular communication sites on the ground (not shown). Central server 132 can be a single processing system, or a group of two or more processing systems that include networking components to interface with wireless and wired communication networks and information networks, and receive data and instructions. Central server 132 can also include logic to generate and transmit traffic signals 136 to stop light 138 to control traffic in the appropriate directions along the route and at intersections to be traveled by emergency vehicles 102.

Figure 1C:
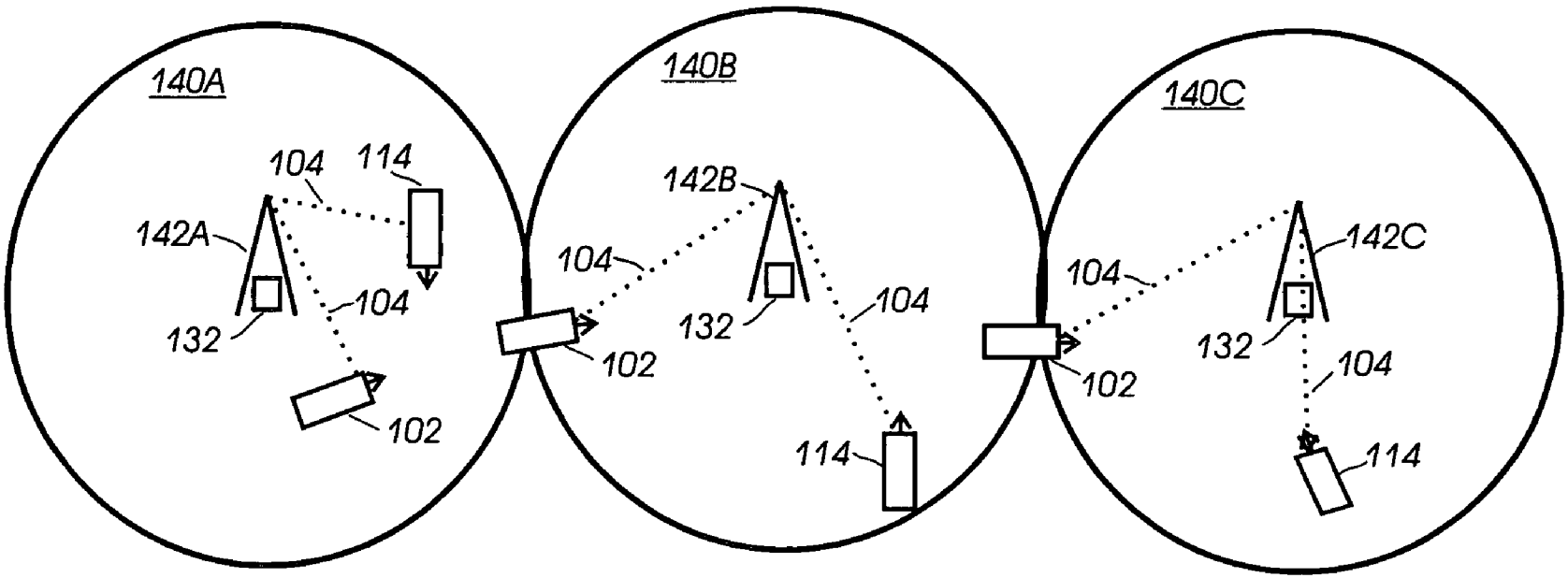
FIG. 1C shows a network of central servers located in different physical locations and configured to communicate data with one another, and with emergency vehicles and commuter vehicles.

FIG. 1C shows a network of central servers 132 including several central servers 132 located in different physical locations and configured to communicate data with one another, emergency vehicles 102, and commuter vehicles 114. Such a network of central servers 132 provides continuity in receiving and transmitting alert signals 104 over a wide geographic area, with transmission areas 140A to 140C denoting the transmission range for each cellular communication site 142A to 142C. The number and location of central servers 132 can be scaled based on factors such as population density, terrain and building clutter, and geographic area to be covered. In the example shown, central servers 132 can are co-located with existing wireless communication ground facilities, such as cellular communication sites 142A to 142C. The responsibility for transmitting alert signals 104 to commuter vehicles 114 transitions to cellular communication site 140B when emergency vehicle (s) 102 travel beyond the transmission area 140A of the previous cellular communication site 142A, and similarly when emergency vehicle 114 travels beyond the transmission area 140B of cellular communication site 142B and into the transmission area 140C of cellular communication site 142C. In other embodiments, it is anticipated that combinations of mobile communication technologies, such as satellites 134 and cellular communication sites 142A to 142C can be utilized to transmit alert signals 104 between commuter vehicles 114 and emergency vehicles 102.

Figure 1D:
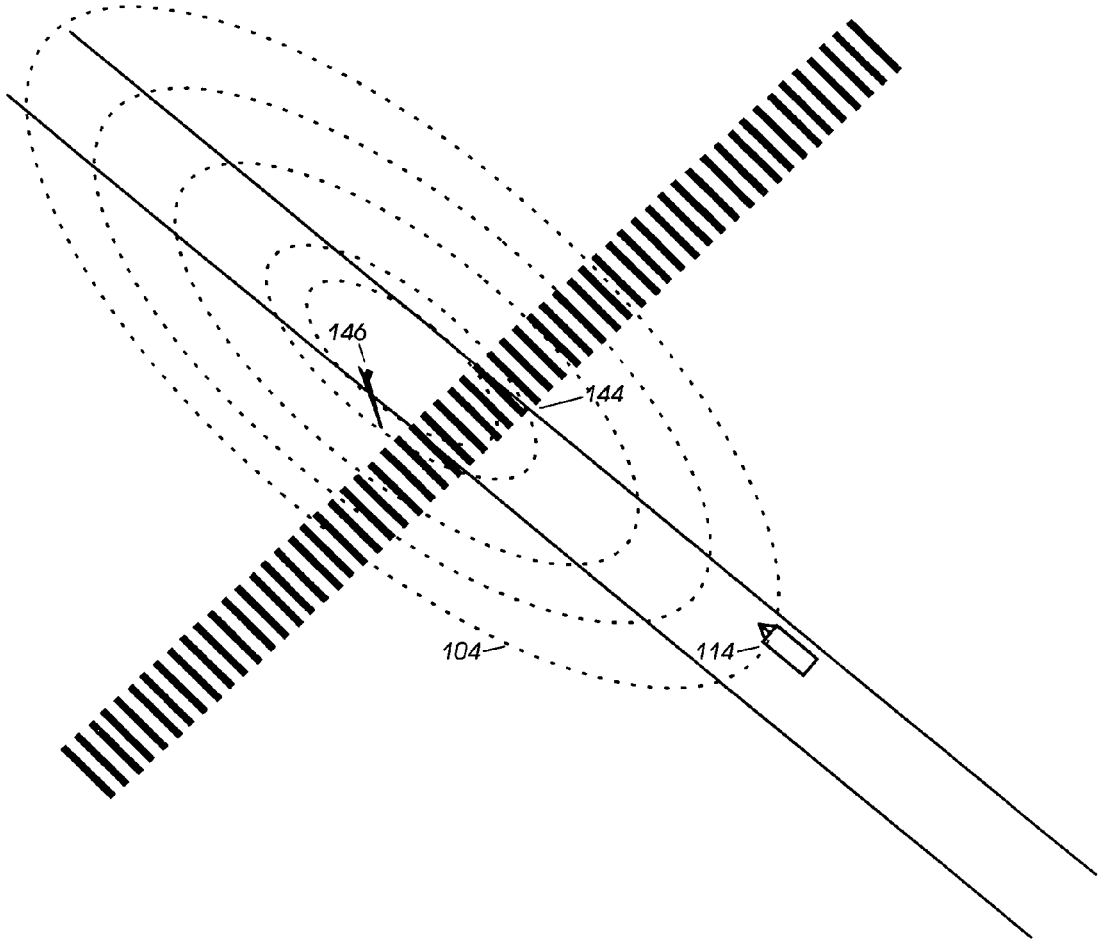
FIG. 1D shows alert signals being transmitted at a railroad crossing to alert commuter vehicles to an oncoming train.

FIG. 1D shows alert transmit system 146 at railroad crossing 144 sending alert signals 104 to alert commuter vehicles 114 to the presence of an oncoming train. Alert transmit system 146 includes components that receive information regarding the distance from the crossing 144 and speed of the oncoming train. Information regarding speed and distance from the crossing 144 can be provided to alert transmit system 146 directly by the train, via central server 132 (FIG. 1C), or another data communication system. Alert signals 104 can be amplified based on the urgency of the alert, i.e., the closer the train and the faster its speed, the stronger the alert signal 104.

Figure 1E:
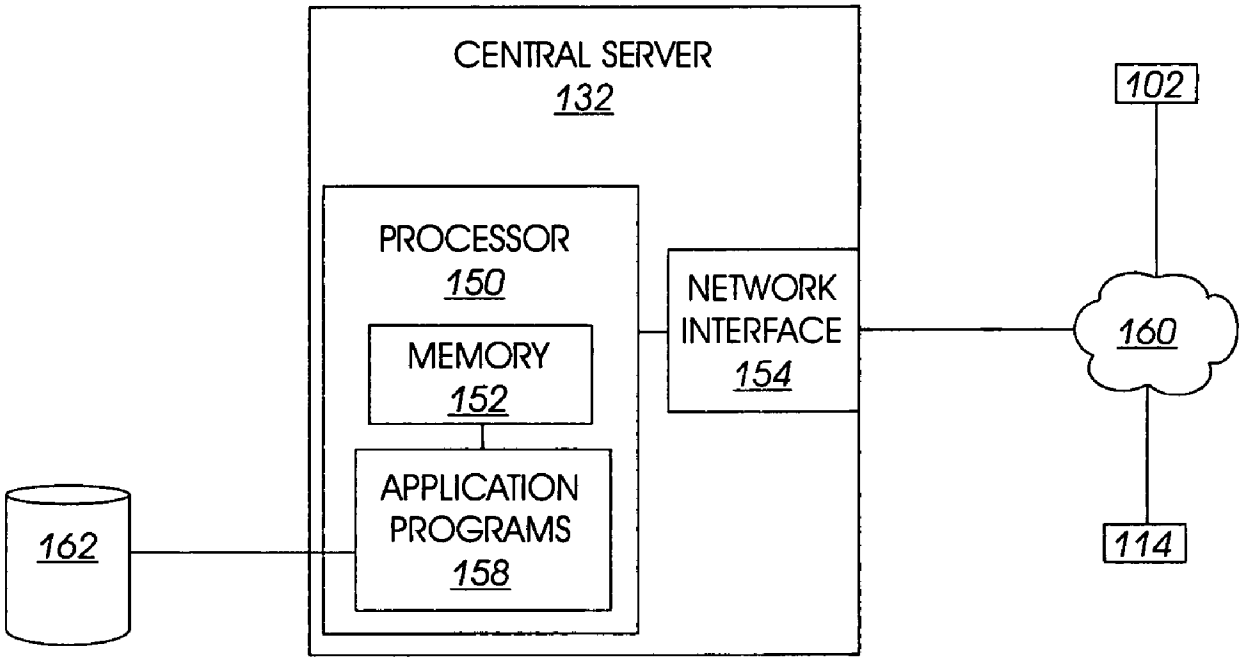
FIG. 1E shows a simplified block diagram of an embodiment of a central server.
Figure 1F:
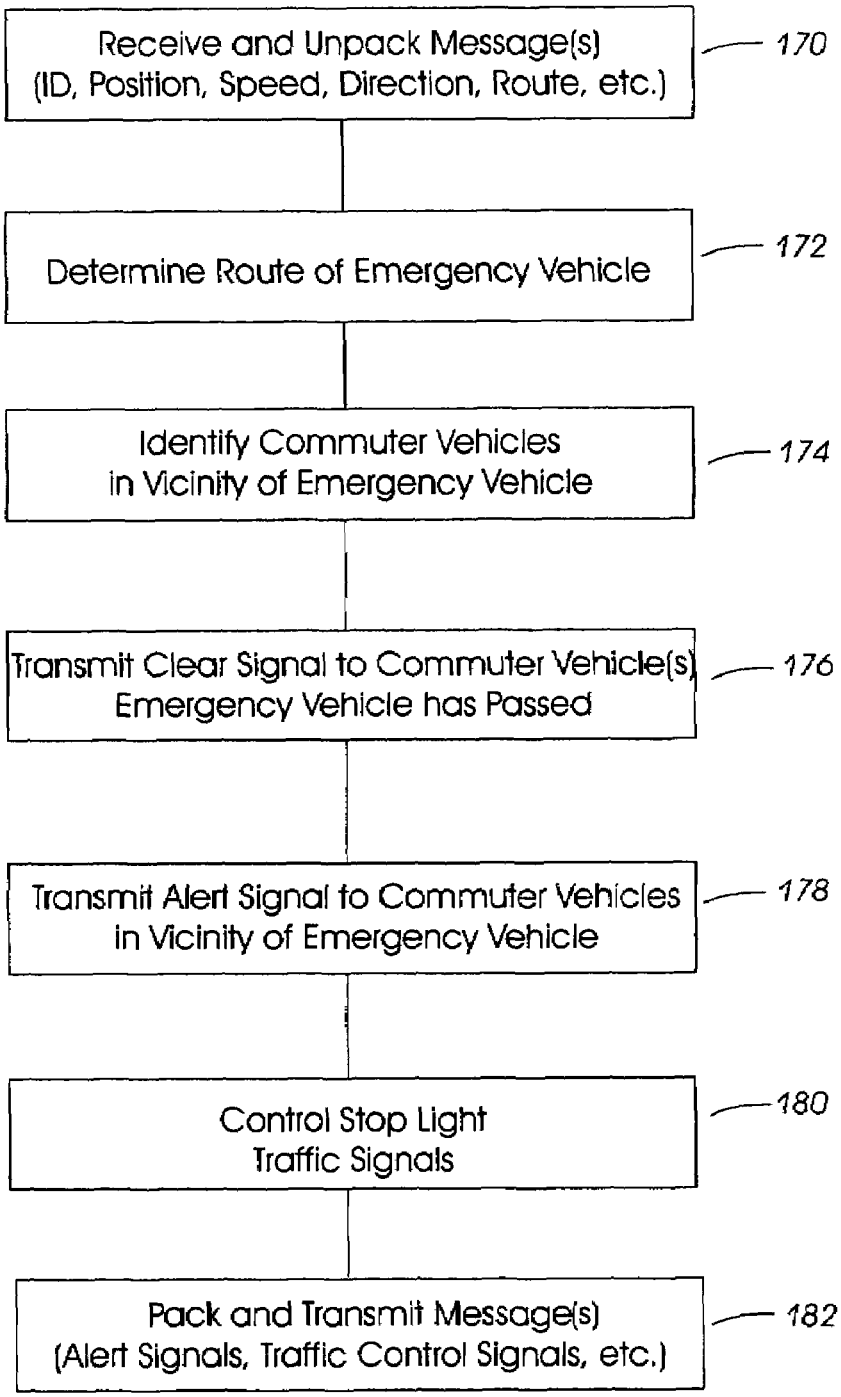
FIG. 1F shows examples of functions that can be performed by central server.

FIG. 1E shows a simplified block diagram of an embodiment of central server 132 including processor 150 with memory 152 and application programs 158. Any suitable type of processor 150, memory 152, and application programs 158 to perform the functions of central server 132 can be utilized to implement central server 132. Referring to FIGS. 1E and 1F, FIG. 1F shows examples of functions that can be performed by central server 132 including function 170 to receive and transmit signals to emergency vehicles 102 and commuter vehicles 114; function 172 to determine travel routes of emergency vehicles 102 and commuter vehicles 114; function 174 to identify commuter vehicles 114 in the vicinity of emergency vehicles 102; function 176 to send signals to clear a corresponding alert in commuter vehicles 114 as each emergency vehicle 102 passes commuter vehicle(s) 114, and function 178 to transmit alert signals to commuter vehicles 114 in the vicinity of emergency vehicles 102.

Network interface 154 enables central server 132 to communicate with emergency vehicles 102 and commuter vehicles 114 via network 160. Central server 132 can also access a map database 162 that allows application programs 158 to extrapolate the time emergency vehicles 102 will arrive at various intersections along the route, and transmit the messages, such as alert signals 104, at appropriate times to commuter vehicles 114 heading toward intersections or other areas along the route of emergency vehicles 102. Information regarding emergency vehicles 102, such as position, speed, direction, and route can be updated periodically in central server 132 from information sent by emergency vehicles 102, or sensor systems capable of monitoring the progress of the emergency vehicles 102 along their route. Central server 132 can also include logic to control stop light signals in the appropriate directions along the route and at intersections to be traveled by emergency vehicles 102, as shown for example by function 180.

Referring again to FIGS. 1A and 2A, radio direction finder (RDF) receiver systems are used to indicate the angle of arrival of an incoming radio frequency wave front for the purpose of locating the source of the transmission. A single RDF may be used on a mobile platform to home in on the source of the transmission, or a network of RDFs may be used to locate the transmission source by triangulation. Alert receiver system 200 can include components such as phase detector 216, waveform generator 218, and RF summing circuit 220 that are utilized along with antenna 204, receiver 206, and processor 210 to provide RDF capability.

Phase detector 216 receives signals from receiver 206 and includes components to perform necessary signal processing functions such as filtering, phase shifting, demodulating, and converting analog signals to digital signals, as required. The output of phase detector 216 includes sine and cosine signals representing the bearing of the transmitting vehicle that is provided to processor 210.

Waveform generator 218 provides control voltages to vary antenna gains in RF summing circuit 220. Typically, a RDF system includes three or more antennas, referred to collectively as antenna 204, and one waveform is used for each RDF antenna. The waveforms are identical except they are displaced in time. For example, a RDF system with four antenna elements requires control waveforms phased 90 degrees apart from each other. By simulating a rotating antenna using varying gains for the antenna elements, the incoming location transmission signals are frequency modulated. The modulation frequency is equal to the rotational speed of the simulated antenna, the deviation is proportional to the antenna spacing, and the phase of the modulation, relative to the reference signal used to control RF summing circuit 220 is equal to the bearing angle of the transmitting device. Waveform generator 218 also supplies timing reference signals to phase detector 216.

RF summing circuit 220 combines location signals received by a group of direction finding antennas, referred to collectively as antenna 204, to generate a single location signal. Any suitable type of direction finding antenna 204, waveform generator 218, phase detector 216, and RF summing circuit 220 can be utilized in alert receiver system 200 to provide RDF capability.

Signals transmitted by emergency vehicles 102 can include components that uniquely identify the vehicle to allow alert receiver system 200 to distinguish emergency vehicles 102 from each other. When processor 210 receives data that identifies oncoming emergency vehicle(s) 102, processor 210 outputs information to display device 212 or audio device 220 to notify the occupants in the corresponding commuter vehicle 114. Processor 210 can access a map database and extrapolate the time emergency vehicles 102 will arrive in their vicinity. In some embodiments, display device 212 is a monitor screen capable of visually displaying emergency vehicles 102. The monitor screen can be incorporated into alert receiver system 200 or be part of a separate system such as a vehicle navigation system capable of receiving input from alert receiver system 200.

Awareness of emergency vehicle(s) 102 in the vicinity allows drivers of commuter vehicles 114 to take appropriate action. The notification can be a light, voice recording, alpha-numeric display, flashing or continuously displayed symbol on a map, or other suitable methods and devices for presenting the alert information. A combination of notification warnings can be used. The voice warning can be selected from an array of digitized voice recordings. Any one of the digitized voice recordings can be selected based on a user's preference. Volume, severity of tone, gender of the voice, and wording of the warning message can all be selected based on the driver's preference. As an additional feature, the voice warning can be recorded by the user with their own voice.

Processor 210 provides information to display device 212 and/or audio device 214 to indicate the number of emergency vehicles 102 in the vicinity, based on identification information in alert signal 104 transmitted by each emergency vehicle 102. Alert signals 104 can include any type of relevant information, such as speed, location, and direction of travel along with identification information. As signals transmitted by each emergency vehicle 102 are no longer transmitted within the detection range of alert receiver system 200, processor 210 can discontinue presenting information regarding the corresponding emergency vehicle 102.

Alert receiver system 200 can also include a transmitter (not shown) to transmit information regarding commuter vehicle 114 to emergency vehicles 102 and/or central server 132. Any relevant information can be provided, such as identification information, position, speed, direction, and route. The information can be transmitted continuously, or intermittently upon receipt of a query signal from emergency vehicles 102, central server 132, or other interrogating device.

When alert receiver system 200 no longer detects any alert signals 104, an all-clear notification can be presented on display 212 and/or audio device 214. The commuter can safely resume travel when all emergency vehicles 102 have departed from the immediate vicinity.

Referring to FIGS. 1A, 1B, 2A and 2B, FIG. 2B is a block diagram of components included in an embodiment of alert transmitter system 250 utilized by emergency vehicles 102 to transmit alert signals 104 to commuter vehicles 114 and/or to central server 132. The embodiment of alert transmitter system 250 shown includes broadcast antenna 252, transmitter 254, encoder 256, processor 260 with memory 270, GPS receiver 262, navigation and route planning module 264, RFID tag 268, and sensor module 266. Other embodiments of alert transmitter system 250 can include fewer components or additional components, depending on the functions to be performed and the distribution of functions among components. For example, alert transmitter system 250 may only transmit location and identification information, thereby eliminating the need for navigation/route planning module 264.

Processor is capable of generating messages including information from GPS receiver 262, navigation/route planning module 264, sensor module 266, and RFID tag 268. The messages can be assembled and formatted using one or more suitable communication protocols such as, for example, mobile IP with code division multiple access (CDMA), wireless application protocol (WAP), or time division multiple access (TDMA), to name a few. Encoder 256 generates serial data that contains the information, and transmitter 254 modulates and transmits the serial data via broadcast antenna 252.

Navigation/route planning module 264 includes a user interface that allows personnel in emergency vehicles 102 to enter destination information. A moving map display can be included to present a visual representation of the most efficient route from the emergency vehicles current location to the destination. Route information can be updated during travel in the event a detour from the previous route is required. The destination and route information can be provided to central server 132.

Sensor module 266 includes one or more sensor systems, such as speedometer 271, RDF module 272, RADAR sensor system 274, and forward looking infrared (FLIR) system 276. Speedometer 271 provides information regarding the speed of the emergency vehicle 102 in which it is installed. Processor 260 can include logic instructions that determine the strength of the alert signal based on the speed of the emergency vehicle 102. The gain of an amplifier (not shown) in transmitter 254 can be adjusted by processor 260 to increase the strength of alert signals 104 associated with very fast moving emergency vehicles 102. RDF module 272 generates a signal that is detected by RDF antennas in alert receiver systems 200 to determine information regarding the location, speed, and direction of the emergency vehicle 102.

Additionally, sensor module 266 can include sensors, such as RADAR sensor system 274 and FLIR system 276, to determine the speed of the nearby commuter vehicles 114 and provide the speed signals to processor 260 to further adjust the strength of alert signals 104 based on the speed of commuter vehicles 114. As another alternative, commuter vehicles 114 can include components to transmit speed, location, and direction information to central server 132, which adjusts the strength of alert signals 104 based on the speed of commuter vehicles 114. As a further alternative, emergency vehicles 102 can include components to receive signals containing this information directly from commuter vehicles 114. A still further alternative includes the use of sensor systems, such as RADAR system 274 and FLIR system 276, to adjust the strength of the alert signal 104 based on the distance, speed, and direction of travel of the closest moving commuter vehicle 114 to the emergency vehicle 102.

Additionally, alert transmitter system 250 can include a long-range high speed setting that is manually selectable by the driver. The high-speed setting is especially applicable to emergency vehicles 102 involved in high speed pursuits. The high-speed setting can be initiated as part of the step of activating an initiation switch. Commuter vehicles 114 equipped with alert receiver system 200 can be forewarned of a high-speed pursuit approaching their vicinity while emergency vehicles 102 are still quite a distance away.

RFID tag 268 can be used to provide information regarding the identity, location, and other characteristic information about emergency vehicle 102 to processor 260. In some embodiments, RFID tag 268 can include a built-in transmitter to emit signals that can be detected and utilized by alert receiver system 200. Thus, RFID tag 268 can provide a backup system to transmitter 254. When RFID tracking devices are installed on roadways, the position and speed of the emergency vehicles 102 can be monitored by the tracking devices. The use of RFID tag 268 can therefore eliminate the need for transmitter 254, encoder 256, processor 260, GPS receiver 262, sensor module 266, and/or navigation/route planning module 264 in some embodiments. As another alternative, the need for RFID tag 268 can be eliminated when identification information for each emergency vehicle 102 is entered and stored in memory 270 associated with processor 260. Information transmitted to identify a vehicle can be any type of data or signal that can be distinguished from other emergency vehicles 102, such as a unique vehicle identification number, or a unique, predetermined signal pattern.

In some embodiments, alert signals 104 are transmitted in the direction that emergency vehicles 102 are traveling. Transmitting alert signals 104 in a full 360 degree circle, causes alert receiver system 200 to continue detecting alert signals 104 until emergency vehicles 102 have traveled a distance where alert signals 104 are too weak to be detected. To overcome this disadvantage, transmitter 254 can emit a forward biased alert signal 104. In some embodiments, alert signals 104 are transmitted in a substantially 180 degree semi-elliptical shaped transmission area in front of and/or to the side of emergency vehicles 102. Other suitable transmission patterns can be utilized. Alert receiver system 200 ceases detecting alert signals 104 as each corresponding emergency vehicle 102 passes commuter vehicle 114. As a result, there is no unnecessary delay to occupants of commuter vehicle 114 after the last emergency vehicle 102 has safely passed.

Position information from GPS receiver 262 can be included in alert signals 104. Notably, since GPS positions are typically accurate to within a few feet, position information can be used to uniquely identify emergency vehicles 102. The GPS components of alert signals 104 are detected by alert receiver system 200, which can indicate the location of emergency vehicles 102 in relation to commuter vehicle 114 on display device 212 and/or audio device 214.

Alert signals 104 can be transmitted by central server 132 and/or emergency vehicles 102 using one or more radio frequencies. Information in alert signals 104 can be updated frequently to provide real-time information to alert receiver system 200.

Knowing the direction from which emergency vehicles 102 are approaching allows a driver of commuter vehicle 114 to determine whether to pull over to the side of the road, stop, or clear a traffic lane. Occasionally, commuter vehicle 114 may be required to clear a lane when emergency vehicles 102 approach in front of commuter vehicle 114 and the opposite traffic lanes are blocked. In contrast, simply stopping in a traffic lane may be the most appropriate response when emergency vehicles 102 are approaching from the side as cross traffic. Just stopping, rather than pulling over to the side, is also appropriate when commuter vehicle 114 is about to enter the same intersection being crossed by emergency vehicles 102.

Figure 3A:
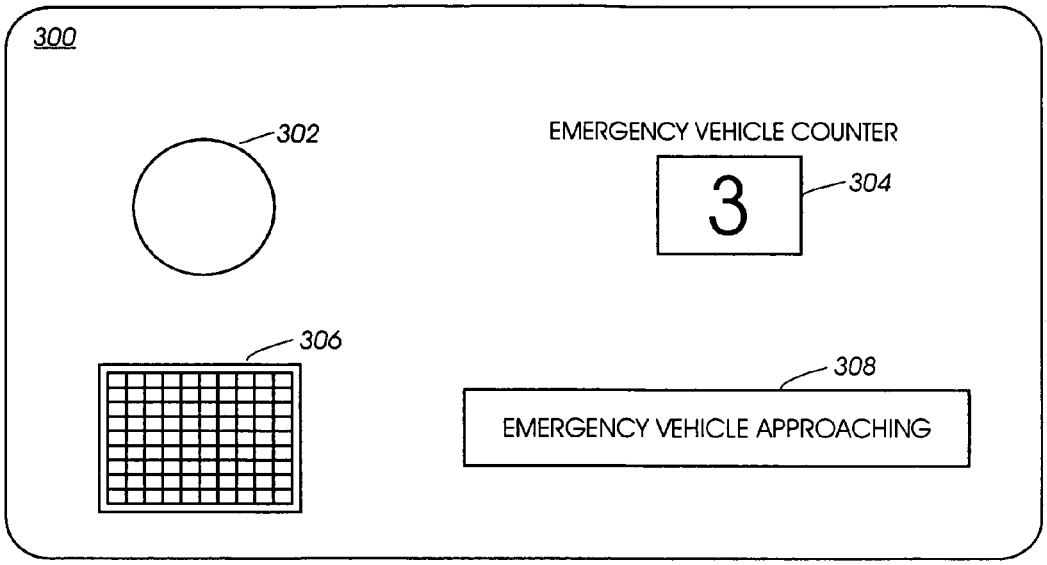
FIGS. 3A, 3B, and 3C show alternate embodiments of audio and visual displays for presenting alert signal information to occupants of commuter vehicles.
Figure 3B:
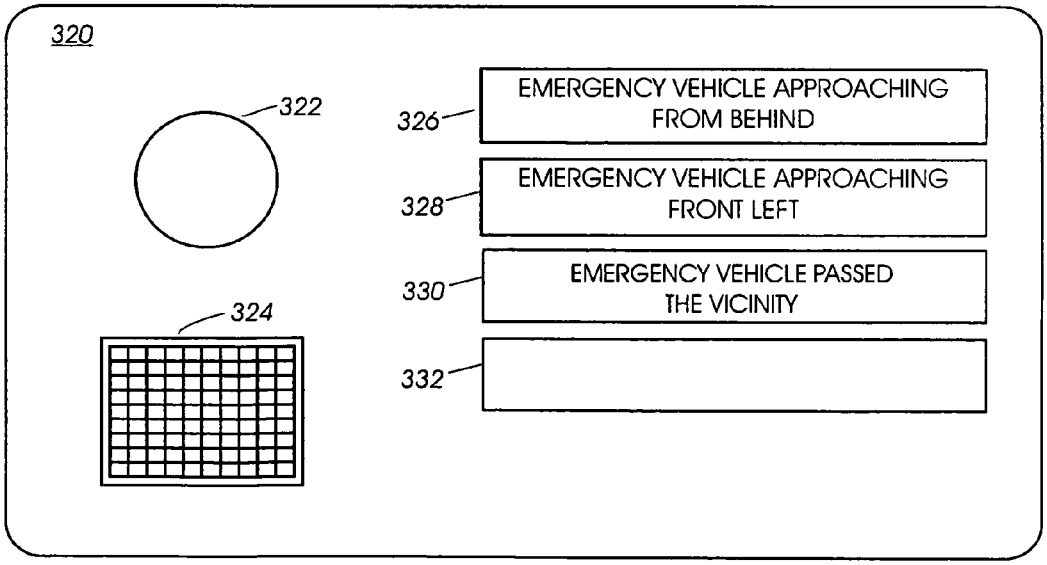
Figure 3C:
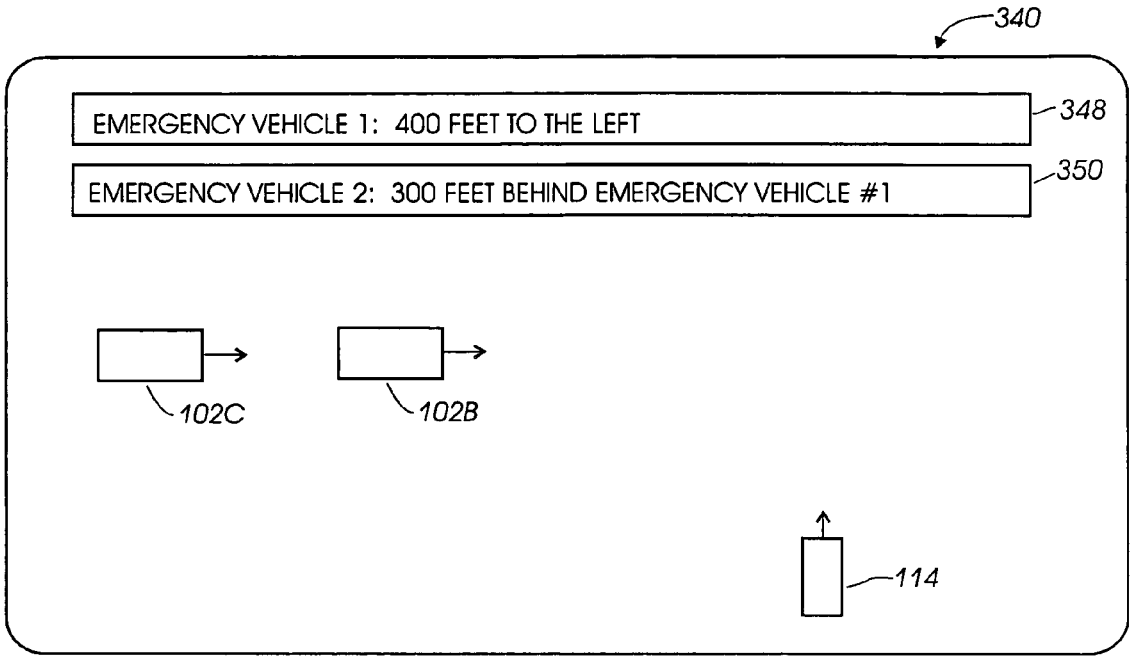

FIGS. 3A, 3B, and 3C show examples of alternate embodiments of combination audio and visual displays 300, 320, 340, respectively, for presenting alert signal information to occupants of commuter vehicle 114.

FIG. 3A shows audio and visual display 300 that includes an azimuth indicator 302 with visual indicators, such as radially spaced light emitting diodes (LEDs), to indicate the location and/or direction of travel of emergency vehicles 102 in relation to commuter vehicle 114. Corresponding LEDs are activated/deactivated as the position and direction of emergency vehicles 102 change relative to commuter vehicle 114. An emergency vehicle counter 304 can be implemented with any suitable device, such as a liquid crystal display (LCD), to indicate the number of emergency vehicles 102 in the vicinity. Audible warnings can be issued through speaker 306, while another readout display 308 can provide more specific information regarding the source of the alert signals. For example, a message indicating that emergency vehicles 102 are approaching can be displayed while emergency vehicles 102 are in the vicinity. An all-clear message can be displayed once emergency vehicles 102 have passed and the commuter vehicle 114 can proceed.

FIG. 3B shows audio and visual display 320 that includes a visual indicator 322, such as light, to indicate the presence of emergency vehicles 102 in the vicinity near commuter vehicle 114. Visual indicator 322 can utilize different colors, such a red to indicate an alert situation, or green to indicate an all-clear condition. Audible warnings can be issued through speaker 324, while a series of readout displays 326 to 332 can provide more specific textual information regarding the position and direction of approaching emergency vehicles 102. Once emergency vehicles 102 have passed, visual indicator 322 is distinguished, and readout displays 326 to 332 are cleared or present an all-clear message.

FIG. 3C shows audio and visual display 340 that includes a monitor with symbols to indicate the number, location, speed, and/or direction of travel of emergency vehicles 344, 346 in relation to commuter vehicle 114. Audible warnings can be issued through a speaker (not shown), while readout displays 348, 350 can provide more specific information regarding emergency vehicles 104, 106. For example, a message indicating the distance of emergency vehicles 102B, 102C from commuter vehicle 114 can be displayed while emergency vehicles 102B, 102C are in the vicinity. An all-clear message can be displayed once emergency vehicles 102B, 102C have passed and commuter vehicle 114 can proceed.

Additionally, or alternatively, information from alert signals 104 can be presented utilizing systems already installed in commuter vehicle 114, such as car audio systems, dashboard lights, and navigation systems with moving map displays.

Emergency vehicles 102 can include police cars, fire trucks, and ambulances, to name a few examples, as well as any other type of vehicle where one or more vehicles transmit a signal to a receiver in another vehicle. For instance, alert transmitter systems 250 can be located at railroad crossings and activated, either manually or automatically, when a train is within a specified distance. The alert signals would be broadcast in a pattern designed to reach commuter vehicles 114 approaching the tracks from any direction in the vicinity.

The advantages of EVAS 100 are numerous. EVAS 100 can transmit alert signals 104 at ranges based on the speed of travel whereas only the volume of a siren can be adjusted to increase the distance projection. An indication of the number emergency vehicles 102 in the vicinity of commuter vehicle 114 is provided. EVAS 100 can be implemented on a nationwide basis to promote uniformity of components and alert signal transmission frequency(s). Additionally, commuter vehicles 114 are provided with information regarding the position of emergency vehicles 102 relative to commuter vehicles 114. EVAS 100 can also be implemented using existing communication infrastructures.

Initially a local government body can elect to install alert transmitter systems 250 on their emergency vehicles 102. Alternately, State or National regulations may be implemented that mandate the installation of the EVAS 100 on emergency vehicles 102 and commuter vehicles 114. Local governments can coordinate the sale and distribution of alert receiver systems 200 to the local populace. Rebates or discounts on the cost of alert receiver systems 200 can be offered by the local government. The notices, advertising, and reduced cost purchases facilitated by the local governments will encourage prompt and extensive implementation of the EVAS 100 program by the local populace and vehicle manufacturers.

Citizens could be prompted to make the purchase of alert receiver systems 200, just as they are required to have smog certification checks. Additionally, the citizens will recognize the value of having a warning alert within their vehicles 114 that will provide notice of a nearby emergency vehicle 102. Many people have experienced hearing the siren of an emergency vehicle 102 moments before the emergency vehicle 102 appears in sight. Often, there is not enough time to calmly pull to the side of the road with the short warning time. The EVAS 100 can provide advanced warning of an approaching emergency vehicle 102.

The EVAS can be uniform in the transmission frequency (s) utilized, or a frequency hopping scheme can be implemented, so that a commuter vehicle 114 can receive alert signals anywhere in the United States. Also, uniformity can reduce the overall cost of implementing the system, as design and manufacturing costs will be reduced by the mass quantity production of similar devices. The effectiveness and safety benefits of the EVAS are significantly enhanced by a nationwide implementation of a uniform system.

While the invention has been described with reference to various embodiments, it will be understood that these embodiments are illustrative and that the scope of the invention is not limited to them. Many variations, modifications, additions and improvements of the embodiments described are possible. For example, those having ordinary skill in the art will readily implement the steps necessary to provide the structures and methods disclosed herein. Further, functions performed by various components can be implemented in hardware, software, firmware, or a combination of hardware, software, and firmware components. Variations and modifications of the embodiments disclosed herein may be made based on the description set forth herein, without departing from the scope of the invention as set forth in the following claims.

In the claims, unless otherwise indicated the article "a" is to refer to "one or more than one".

What is claimed is:

1. An apparatus for alerting occupants in a commuter vehicle to the presence of a plurality of emergency vehicles in the vicinity, comprising:

a receiver operable to receive signals transmitted by at least one of the emergency vehicles;

a processor coupled to communicate with the receiver, wherein the processor is operable to:

determine whether the signals include information to distinguish the at least one emergency vehicle from the other emergency vehicles;

activate an alert when the at least one emergency vehicle is distinguished;

indicate the number of the at least one emergency vehicles in the vicinity based on the distinguishing information; and activate an all-clear indicator when the at least one emergency vehicles have traveled past the location of the commuter vehicle.

2. The apparatus of claim 1, wherein the processor is further operable to count down the number of the at least one emergency vehicles in the vicinity as each of the at least one emergency vehicles travel past the location of the commuter vehicle.

3. The apparatus of claim 1, wherein the signals include information regarding the location of the at least one emergency vehicle, and the processor is further operable to update a display representing the position of the at least one emergency vehicle in relation to the commuter vehicle.

4. The apparatus of claim 1 wherein the signals are radio frequency signals.

5. The apparatus of claim 4 further comprising a radio direction finder coupled to the receiver, wherein the position of the at least one emergency vehicle is determined using the radio direction finder.

6. The apparatus of claim 3 wherein the signal includes latitude and longitude information for the at least one emergency vehicle.

7. The apparatus of claim 1 wherein the signals include information regarding the speed of the at least one emergency vehicle.

8. The apparatus of claim 1 wherein the signal includes information regarding the direction of travel of the at least one emergency vehicle.

9. The apparatus of claim 1, wherein the strength of the signal indicates the position of the at least one emergency vehicle relative to the commuter vehicle.

10. The apparatus of claim 1, wherein the signals have a targeted transmission area.

11. The apparatus of claim 1, wherein the alert comprises at least one of a group of a voice warning, a light, an alphanumeric display, and a symbol on a map display.

12. The apparatus of claim 1, wherein the apparatus is operable to receive an alert signal proximate a railroad crossing to indicate the presence of an oncoming train.

13. An apparatus for transmitting alert signals to commuter vehicles in the vicinity of an emergency vehicle, comprising:

a transmitter operable to transmit radio frequency signals;

an encoder configured to communicate with the transmitter, wherein the encoder is operable to include information to uniquely identify the emergency vehicle from other emergency vehicles in the vicinity of the commuter vehicle; and a switch configured to allow an operator to directly control the strength of the signals transmitted by the emergency vehicle.

14. The apparatus of claim 13, further comprising a processor configured to communicate with the encoder.

15. The apparatus of claim 14, wherein the processor is operable to communicate information to the encoder regarding at least one of the group of: the position; the identity; the direction of travel; and the speed of the emergency vehicle.

16. The apparatus of claim 14, wherein the processor is operable to generate mobile IP messages to be transmitted by the transmitter.

17. The apparatus of 14, wherein the apparatus is installed proximate a railroad crossing to alert the commuter vehicle to the presence of an oncoming train.

18. A method for alerting occupants in a commuter vehicle to the presence of a plurality of emergency vehicles in the vicinity, comprising:

receiving signals transmitted by at least one of the emergency vehicles;

determining whether the signals include information to distinguish the emergency vehicles from one another;

activating an alert when at least one emergency vehicle is distinguished;

indicating the number of emergency vehicles in the vicinity based on the distinguishing information; and activating an all-clear indicator when all of the distinguished emergency vehicles have traveled past the location of the commuter vehicle.

19. The method of claim 18, further comprising counting down the number of emergency vehicles in the vicinity as each emergency vehicle travels past the location of the commuter vehicle.

20. The method of claim 18, wherein the signal includes information regarding the location of the at least one distinguished emergency vehicle, the method further comprising updating the position of the at least one distinguished emergency vehicle in relation to the commuter vehicle.

21. The method of claim 18 wherein the signal is a radio frequency signal.

22. The method of claim 21 wherein the signal includes a RFID component.

23. The method of claim 22 wherein the position of the at least one emergency vehicle is determined using a radio direction finding system.

24. The method of claim 18 wherein the signal includes latitude and longitude information for the at least one distinguished emergency vehicle.

25. The method of claim 18 wherein the signal includes identification information for the at least one distinguished emergency vehicle.

26. The method of claim 19 wherein the signal includes speed information for the at least one distinguished emergency vehicle.

27. The method of claim 18 wherein the signal includes information regarding the direction of travel for the at least one distinguished emergency vehicle.

28. The method of claim 18, wherein the strength of the signal indicates the position of the at least one emergency vehicle relative to the commuter vehicle.

29. The method of claim 18, wherein the signal has a targeted transmission area.

30. The method of claim 18, wherein the alert comprises at least one of the group of: a voice warning, a light, an alphanumeric display, and a symbol representing the position of the at least one emergency vehicle in relation to the commuter vehicle.

31. The method of claim 18, wherein the signal is transmitted to the commuter vehicle in the vicinity of a railroad crossing when a train is approaching the railroad crossing.

32. A system for transmitting signals from a plurality of first vehicles to a second vehicle, comprising:

a network interface operable to transmit data to and receive data from an information network, wherein the data includes signals from the plurality of first vehicles;

a processor operable to determine the number of first vehicles in the vicinity of the second vehicle and to generate a message to send to the second vehicle regarding the number and location of first vehicles in the vicinity of the second vehicle; and the network interface and the processor are at a remote location external to the plurality of first vehicles and the second vehicle.

33. The system of claim 32, wherein the processor is further operable to determine the route of the first vehicles.

34. The system of claim 32, wherein the message includes information regarding the number of first vehicles that have passed by the route of the second vehicle.

35. The system of claim 32, wherein the processor is further operable to periodically update the position of the first vehicles in the message sent to the second vehicle.

36. The system of claim 32, wherein the processor is further operable to generate a message to control traffic signals along the route of the first vehicles.

37. The system of claim 32, wherein the network interface transmits and receives signals using wireless communication.

38. The system of claim 32, wherein the message includes information regarding the speed of the first vehicles.

39. The system of claim 32, wherein the first vehicles are emergency vehicles transmitting alert signals.

40. The system of claim 32, wherein the second vehicle is a commuter vehicle.

41. The system of claim 32, wherein at least one of the first vehicles is a train, and the alert signals are transmitted to second vehicles in the vicinity of a railroad crossing being approached by the train.

42. The apparatus of claim 1, wherein the processor is further operable to display the routes of the emergency vehicles in the vicinity.

43. The apparatus of claim 1, wherein the processor is further operable to extrapolate the arrival time of the emergency vehicles in the vicinity of the commuter vehicle.

44. The apparatus of claim 13, wherein the strength of the signals are based on the speed of at least one of the commuter vehicles in the vicinity of the emergency vehicle.

45. The apparatus of claim 13, wherein the encoder is further operable to encode signals to control traffic signals in the vicinity of the emergency vehicle.

46. The method of claim 18, further comprising varying the intensity of the alert based on the speed of at least one of: at least one of the emergency vehicles and the commuter vehicle.

47. The method of claim 18, further comprising extrapolating the arrival time of at least one of the emergency vehicles to the vicinity of at least one of the commuter vehicle, and varying the intensity of the alert based on the proximity of the at least one emergency vehicle to the at least one of the commuter vehicles.

48. The system of claim 32, wherein the processor is included in a central server and is further operable to generate information regarding the first vehicles to transmit to another central server along the respective routes of the first vehicles.

49. The system of claim 32, wherein The processor is further operable to extrapolate the arrival time of at least one of the first vehicles in the vicinity of the second vehicle, and to vary the intensity of the alert signal based on the proximity of the at least one first vehicle to the second vehicle.

50. The system of claim 34, wherein the processor is further operable to generate commands to control traffic signals along the routes of the first vehicles.

* * * * *